US006658230B2

(12) United States Patent
Satoh

(10) Patent No.: US 6,658,230 B2
(45) Date of Patent: Dec. 2, 2003

(54) FIXING APPARATUS AND IMAGE-FORMING DEVICE

(75) Inventor: Masahiko Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/159,102

(22) Filed: Jun. 3, 2002

(65) Prior Publication Data

US 2002/0197089 A1 Dec. 26, 2002

(30) Foreign Application Priority Data

Jun. 4, 2001 (JP) ..... 2001-168335
Jun. 25, 2001 (JP) ..... 2001-191709
May 7, 2002 (JP) ..... 2002-131238

(51) Int. Cl.[7] ..... G03G 15/20
(52) U.S. Cl. ..... 399/333; 399/324; 399/331
(58) Field of Search ..... 219/216; 399/320, 399/324, 328, 330, 331, 333; 430/109, 111

(56) References Cited

U.S. PATENT DOCUMENTS 5,300,996 A 4/1994 Yokoyama et al.
5,400,123 A 3/1995 Sato et al.
5,717,988 A * 2/1998 Jinzai et al. ..... 399/333
5,832,354 A 11/1998 Kouno et al.
RE36,124 E 3/1999 Yokoyama et al.
5,915,147 A 6/1999 Kouno et al.
5,966,578 A * 10/1999 Soutome et al. ..... 399/333
5,970,298 A 10/1999 Seki et al.
6,226,475 B1 5/2001 Kabumoto et al.
6,259,866 B1 7/2001 Kabumoto et al.
6,305,636 B1 10/2001 Satoh et al.
6,389,249 B2 5/2002 Kabumoto et al.
6,396,410 B1 5/2002 Kabumoto et al.

FOREIGN PATENT DOCUMENTS

JP 5-40425 2/1993
JP 8-286534 11/1996
JP 10-26895 1/1998
JP 2000-122453 4/2000
JP 2001-51544 2/2001
JP 3174987 4/2001

* cited by examiner

*Primary Examiner*—Hoang Ngo
(74) *Attorney, Agent, or Firm*—Oblon, Spivak, McClelland, Maier & Neustadt, P.C.

(57) ABSTRACT

A fixing apparatus comprises a transfer unit that obtains a visible image from an electrostatic latent image formed on a latent image bearing body using a developer and transfers the visible image onto a medium, and a fixing roller and a pressure roller, positioned opposite to each other with a transfer pass for the medium therebetween, that fix the visible image on the medium. The developer contains a toner having a volume mean grain size of from 5 to 10 micrometers and a grain size not larger than 5 micrometers accounting for 60 through 80 number percent. The surface resistivity of the pressure roller is between 1×107 through 1×1010 Ω/square.

20 Claims, 2 Drawing Sheets

| SURFACE RESISTIVITY | $10^5$ | $10^6$ | $10^7$ | $10^9$ | $10^{10}$ | $10^{11}$ | $10^{13}$ |
|---|---|---|---|---|---|---|---|
| FINE NON-UNIFORM TONER (PULVERIZATION NOT ADJUSTED) | BAD | BAD | GOOD | EXCELLENT | GOOD | ORDINARY | BAD |
| FINE UNIFORM TONER (PULVERIZATION ADJUSTED) | ORDINARY | GOOD | GOOD | EXCELLENT | EXCELLENT | GOOD | BAD |
| COARSE TONE | GOOD | EXCELLENT | EXCELLENT | EXCELLENT | EXCELLENT | GOOD | BAD |

(MEANING OF THE SIGNS (OFFSET-CONFIRMED STATUS))
EXCELLENT → OFFSET NOT NOTICED
GOOD → INSIGNIFICANT LEVEL OF OFFSET
ORDINARY → OFFSET NOTICED
BAD → HIGHLY SIGNIFICANT LEVEL OF OFFSET NOTICED

| SURFACE RESISTIVITY | $10^5$ | $10^6$ | $10^7$ | $10^9$ | $10^{10}$ | $10^{11}$ | $10^{13}$ |
|---|---|---|---|---|---|---|---|
| FINE NON-UNIFORM TONER (PULVERIZATION NOT ADJUSTED) | BAD | BAD | GOOD | EXCELLENT | GOOD | ORDINARY | BAD |
| FINE UNIFORM TONER (PULVERIZATION ADJUSTED) | ORDINARY | GOOD | GOOD | EXCELLENT | EXCELLENT | GOOD | BAD |
| COARSE TONE | GOOD | EXCELLENT | EXCELLENT | EXCELLENT | EXCELLENT | GOOD | BAD |

(MEANING OF THE SIGNS (OFFSET-CONFIRMED STATUS))

EXCELLENT → OFFSET NOT NOTICED

GOOD → INSIGNIFICANT LEVEL OF OFFSET

ORDINARY → OFFSET NOTICED

BAD → HIGHLY SIGNIFICANT LEVEL OF OFFSET NOTICED

*FIG. 3*

FIXING APPARATUS AND IMAGE-FORMING DEVICE

FIELD OF THE INVENTION

This invention relates to a fixing apparatus having an anti-offset construction and an image-forming device that uses the fixing apparatus.

BACKGROUND OF THE INVENTION

Some of the copiers, facsimiles, printers, printing presses or other image-forming devices utilize the method of electrophotography for forming images.

In electrophotography, an electrostatic latent image borne on a photoreceptor is subjected to visible image processing using a developer. The photoreceptor is also called a latent image bearing body that bears a latent image. The developer is, for example, a toner.

There are two types of developers. That is, a one-component type developer and a two-component type developer. The one-component type developer is itself endowed with electrostatic and electromagnetic properties and is transferred and adhered to the electrostatic latent image. On the other hand, the two-component type developer contains two distinct constituents, a toner and a carrier. Recently, both of the developers are made finer and finer to improve the image quality, dot reproducibility and sharpness.

The transfer unit transfers the visible image, namely the toner-developed image borne on the photoreceptor onto a medium. After such transfer, the image on the medium is fixed.

In an example of the fixing process, a single roller is set in direct contact with the toner-covered medium. The heat and pressure of the roller heats up and melts the toner. As a result, the toner penetrates into the medium. This method is called a thermal roller fixing system.

The thermal roller fixing system includes a fixing roller with a built-in heat source and a pressure roller provided opposite to the fixing roller. The surface of the fixing roller is covered with a medium release layer to prevent offset. This medium release layer is made of a medium release lubricant such as Teflon (registered trademark). The surface of the pressure roller is covered with an elastic layer made of silicone rubber.

The pressure roller is pressure fit to the fixing roller. The pressure roller has its elastic layer so deformed as to imitate the peripheral profile of the fixing roller. The combination of the pressure roller and the fixing roller constitutes a fixing nip.

The thermal roller fixing system is advantageous as compared to a belt-using fixing system. The reasons are as follows. That is, thermal roller fixing system very effectively makes use of the working of heat and pressure, and the fixing efficiency in the thermal roller fixing system is high. As a result, the thermal roller fixing system is being preferably used in image formation over the belt-using fixing system.

As explained above, when the toner is finer it improves the dot reproducibility and sharpness, therefore it is advantageous to use a finer toner. A finer toner in which a volume mean grain size is between 5 through 10 micrometers is know. However, during the manufacture of a toner having above-mentioned grain size, toner particles having still finer size are inadvertently generated in great number. The grain size of such toner particles is below 5 micrometers and they account for 60 through 80 number percent in ratio. Such toner particles will be collectively called micro-fine toner for convenience sake.

It is disadvantageous for the image-forming devices if the ratio of the micro-fine toner increases. Therefore, grain size of the toner is so adjusted that the micro-fine toner accounts for about 10 number percent in ratio.

However, there is an increased demand for lower costs and resource conservation involving toner. The manufacturing process becomes complicated if a toner having almost uniform grain size is to be manufactured by removing micro-fine toner from the toner. This also increases the manufacturing cost. Moreover, the micro-fine toner separated from the toner is generally disposed so that there is a loss of resources. As a result, there is a growing demand that, it should become possible to use a toner as it is even if the micro-fine toner is mixed in it in a specific ratio. Concretely, there is a growing demand that, a toner having a volume mean grain size of from 5 through 10 micrometers and a grain size not larger than 5 micrometers accounting for 60 through 80 number percent can be used in the image-forming devices. Hereafter such a toner will be called a fine toner.

If a visible image is formed using a finer toner that contains micro-fine toner, the toner is liable to become liberated under the influence of static electricity. In the image-forming devices, the fixing roller and the pressure roller are interlocked so as to rotate during the image forming operation. As a result of friction between the rollers, there is generated an electrical charge of the order of 0 through minus 5 KV. During the image forming operation, the toner is fixed to the medium only because of the static electric force. However, since there is the electrical charge generated due to friction between the rollers, the toner fixed to the medium gets separated from the medium, becomes airborne, and finally gets adhered to the fixing roller. Take an example of a digital copier where a toner-developed visible image is negatively charged at a low value and the visible image transferred on the medium is attracted and adhered thereto by the positive electrostatic force induced onto the medium side.

As explained above, the surface of the pressure roller in the fixing apparatus is provided with a Teflon or other insulating layer. The Teflon insulator constitutes an extensive, negatively charged portion for which very reason, on entering the fixing apparatus, the toner-developed visible image is subject to the repulsion between itself and the large negative electrostatic force of the pressure roller. Should the visible image be thereby repulsed and get adhered onto the fixing roller, offset ensues.

Occurrence of this phenomenon is not limited to the finer toner alone. Such phenomenon is observed in conventional toner with a volume mean grain size not falling below 20 micrometers. Moreover, it is also noticed in the toners with the volume mean grain size reduced to around 5 through 10 micrometers and from which micro-fine toner has been removed.

It has already been confirmed that offset can be rendered inconspicuous if the surface resistivity of the pressure roller is made as lower as ranging from $1\times10^{10}$ through $1\times10^{12}$ Ω/square, and the ratio of micro-fine toner is low compared to conventional toner. However, it was confirmed with experiments that, offset did occur in case of the finer toner, despite the surface resistivity of the pressure roller having being lowered to around $1\times10^{10}$ through $1\times10^{12}$ Ω/square.

On the other hand, in order to prevent this offset, a technique of rendering the pressure roller surface electroconductive (which in terms of surface resistivity being around $1\times10^2$ through $1\times10^4$ Ω/square) has often been attempted.

In the case of conventional toner with a volume mean grain size of not less than 20 micrometers, the toner itself with substantial weight is rendered electroconductive and as the toner enters the fixing apparatus the electric charge initiates an electrostatic discharge, during which period the toner retains its own weight and so offset is reduced. By contrast, for finer toner, as soon as a visible image enters the fixing apparatus, the visible image is electrically shocked by the abrupt discharge of electric charges between the visible image on the medium and the pressure roller positioned just behind the medium. Because of this electric shock, the toner (micro-fine toner, particularly) on the image surface becomes liberated towards the fixing roller, hence offset occurs as a result. These phenomena get significant when use is made of the kind of paper (medium) having high resistivity that tends to boost the amount of electrostatic charge (including the case as at a second side fixing where the moisture content of the medium is more or less found lost in the fixing step of a first side in a two-sided copying mode).

SUMMARY OF THE INVENTION

The object of this invention is to provide both a fixing apparatus which is configured such that as fine-toner developed image, namely a visible image in an electrostatic state enters the fixing apparatus, any change in the electrostatic state is curbed so as to prevent offset from resulting, and an image-forming device that uses the fixing apparatus.

The fixing apparatus and the image-forming device according to the present invention comprises a transfer unit that obtains a visible image from an electrostatic latent image formed on a latent image bearing body using a developer and transfers the visible image onto a medium, and a fixing roller and a pressure roller, positioned opposite to each other with a transfer pass for the medium therebetween, that fix the visible image on the medium. The developer contains a toner having a volume mean grain size of from 5 to 10 micrometers and a grain size not larger than 5 micrometers accounting for 60 through 80 number percent. The surface resistivity of the pressure roller is between $1\times10^7$ through $1\times10^{10}$ Ω/square.

Other objects and features of this invention will become apparent from the following description with reference to the accompanying drawings.

BRIEF DESCRIPTION OF THE DRAWINGS

FIG. 3 shows an experimental result of surface resistivity and the state of occurrence of offset.

DETAILED DESCRIPTIONS

Embodiments of the fixing apparatus and the image-forming device according to this invention will be explained in detail below with reference made to the accompanying drawings.

Figure 1:
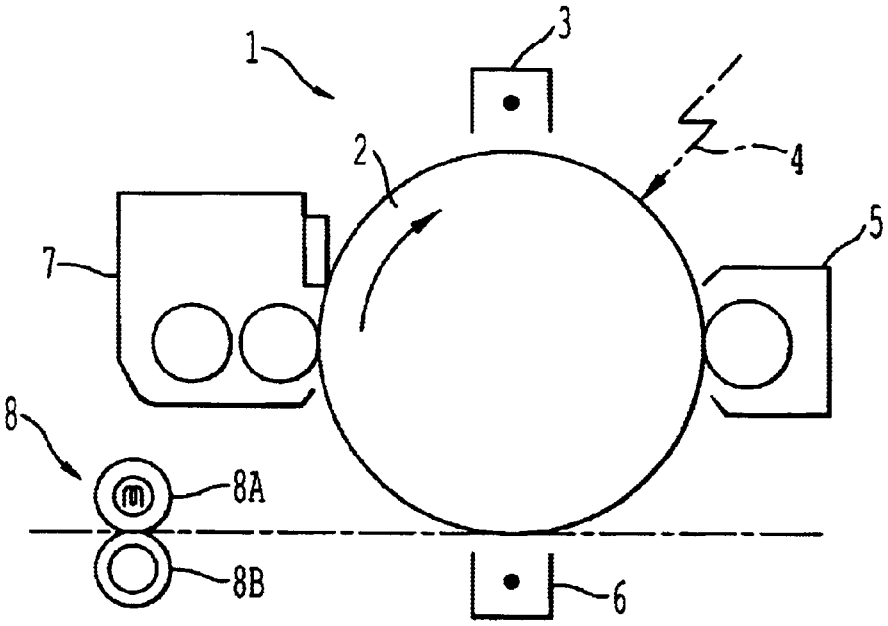
FIG. 1 is a schematic drawing of an example of the image-forming device according to an embodiment of this invention, FIG. 2 a schematic drawing of the main configuration of the fixing apparatus used in the image-forming device shown in FIG. 1.

FIG. 1 is a schematic drawing of the image-forming device installed with the fixing apparatus according to an embodiment of this invention. The image-forming device shown schematically is a copier capable of forming electrostatic latent images by exposure light. As a matter of course, according to this invention, not only a copier but also a printer, facsimile or a printing press become the target of this image-forming device.

In FIG. 1, the copier 1 is equipped with a photoreceptor drum 2 as a latent image bearing body. Around the photoreceptor drum 2 is laid out a range of equipment from an electrostatic charger 3, an exposure device 4, a developing device 5, a transfer device 6 to a cleaning device 7 that together execute image formation processing in the rotational process.

In the copier 1, on completion of uniform electrostatic charging by the electrostatic charger 3, an electrostatic latent image is formed on the photoreceptor drum 5 through the exposure device 4, the electrostatic latent image being then put to a visible image processing using the toner that the developing device 5 supplies. On being thus visible image-processed by the developing device 5, the toner-developed visible image on the photoreceptor drum 2 is transferred through the transfer device 6 onto the medium paid out from a non-illustrated feeding device. After the transfer operation, the photoreceptor drum 2 is cleaned of non-transferred toner or residual electric charge by the cleaning device 7, and subjected to uniform electrostatic charging by the electrostatic charger 3 before the photoreceptor stands by for image formation.

The developer for use in the developing device 5 has a volume mean grain size of from 5 to 10 micrometers and a grain size not larger than 5 micrometers accounting for 60 through 80 number percent. The toner is composed of resin constituents, colorants, wax constituents, and inorganic particulates and is manufactured by pulverization or a polymerization.

For resin constituents, any known resins may be used singly or in combination, including the following: styrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic acid ester copolymer, styrene-α-chloroacrylic methyl copolymer, styrene-acrylonitrile-acrylic ester copolymer and other styrene resins (polymers or copolymers containing styrene or styrene substitution product), polyester resin, epoxy resin, vinyl chloride resin, rosin modified maleic acid resin, phenol resin, polyethylene resin, polyester resin, polypropylene resin, petroleum resin, polyurethane resin, ketone resin, ethylene-ethylacrylate copolymer, xylene resin, and polyvinyl butyral.

For the colorant, a selection is made from a known group comprising carbon black, lampblack, iron black, ultramarine blue, nigrosine dye, aniline blue, chalco oil blue, oil black, and azo oil black but the selection is not particularly limited thereto.

The wax constituent may be selected from a known group comprising a carnauba wax, rice wax, and synthetic ester wax but the selection is not particularly limited thereto.

The inorganic particulates are selected from a known group comprising silica and titanium oxide particulates.

Concerning the medium with a toner-developed visible image transferred on it, the medium is sent down the carrier pass extended from the transfer point towards the non-illustrated delivery section, the visible image being fixed by the fixing apparatus 8 disposed on the carrier pass.

For the fixing apparatus 8, the fixing roller 8A with a built-in heat source A1 (see FIG. 2) and the pressure roller 8B are set opposed to each other with the carrier pass for the medium sandwiched between them such that the heat and pressure of the rollers heats up and melts the toner, which in turn penetrates into the medium in a method called a thermal roller fixing system.

Figure 2:
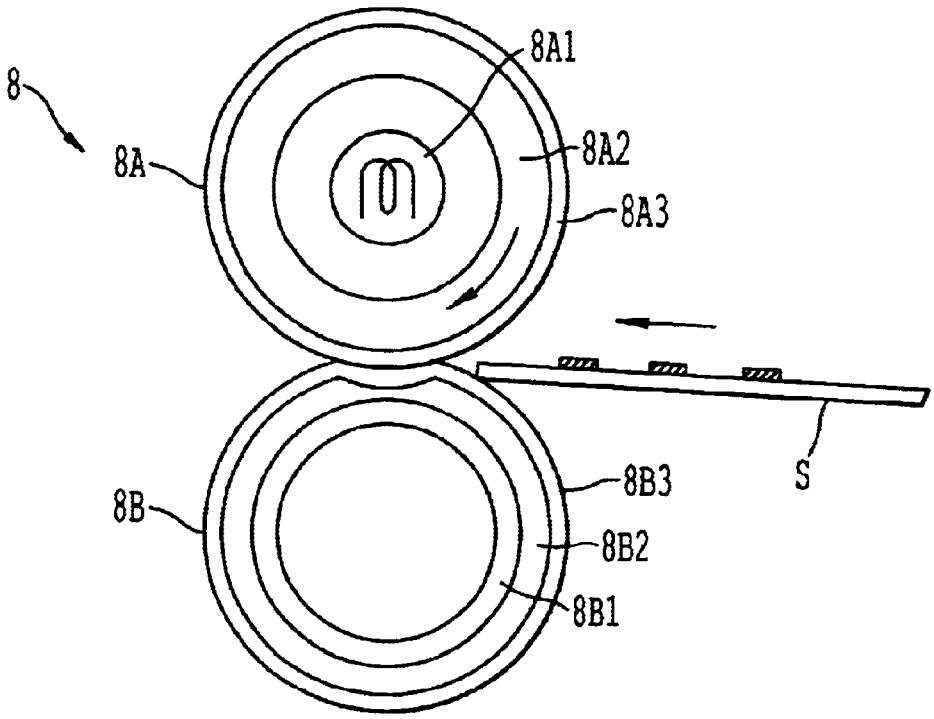

FIG. 2 is a detail drawing of the fixing apparatus 8. The fixing roller 8A comprises the roller core 8A2 that consists of a thermal conductor of aluminum, iron, stainless steel or brass with a built-in heat source 8A1. The roller surface is coated with an anti-offset layer 8A3 using a medium releasing lubricant composed of tetrafluoroethylene-perfluoro alkylvinyl ether (PFA), polytetrafluoroethylene (PTFE) and/or other ingredients. The fixing roller 8A is set to 150 through 200 degrees centigrade monitored by a non-illustrated temperature detecting sensor.

Concerning the pressure roller 8B, the surface of the roller metal core 8B1 is coated with an insulating layer 8B2 of silicone rubber, with the roller surface layer overlaid with a coating 8B3 of tetrafluoroethylene-perfluoro alkylvinyl ether (PFA).

Of the surface region of the pressure roller 8B, the coated later 8B3 contains an electroconductive agent of spherical carbon, the percentage composition of the electroconductive agent being controlled at a quantitative level where the following values can be obtained as the surface resistivity of the pressure roller 8B. Namely, the percentage composition of the electroconductive agent is conditional on the surface resistivity of the pressure roller being less than $1\times10^{10}$ Ω/square at a measuring voltage of 500V and not less than $1\times10^{7}$ Ω/square at 10 V.

As concerns the surface resistivity of the pressure roller 8B, measurements are taken using "Yushi Denshi"—manufactured "Hi-Rester IP", under the measuring voltage condition of 500V and 10 V.

In those measurements, given such a high measuring voltage as 500V, measurements can be made of a sample without problems at a surface resistivity of $1\times10^{9}$ through $1\times10^{11}$ Ω/square or thereabouts, but at $1\times10^{5}$ through $1\times10^{7}$ Ω/square or thereabouts, it is difficult to obtain correct values of the sample. On the other hand, given a measuring voltage of 10 V, measurements can be made without problems if and when the surface resistivity is $1\times10^{5}$ through $1\times10^{8}$ Ω/square or thereabouts, but it gets difficult to obtain correct values of the sample. Because of this, in order to obtain correct values of the sample at surface resistivity of $1\times10^{7}$ through $1\times10^{10}$ Ω/square or thereabouts, measurements are taken in both ways.

With the surface resistance of the pressure roller 8B set as above, the electrostatic voltage that arises when the pressure roller rotates in contact with the fixing roller 8A is maintained at around 0 through minus 1 KV, a level of voltage low compared to a conventional level of 0 through minus 5 KV. When the developer used is measured in the blow-off method for a toner to carrier mixing ratio (TC) and for the amount of electrostatic charge (Q/M), the amount of electrostatic charge (Q/M) stands at 40 through 50 micro C/g and the mixing ratio (TC) at 3 through 5 weight percent.

In this embodiment, configured as it is as above, when the fixing roller 8A is driven by a non-illustrated driving unit, the pressure roller that constitutes a fixing nip in pressure-fit contact with the fixing roller 8A interlocks via frictional force and rotates at constant velocity.

The pressure roller 8B that rotates interlocked with the fixing roller 8A may cause electrostatic charge to arise at the roller surface layer as a result of frictional contact, but the surface resistance of the coated layer 8B3 on the surface layer of the pressure roller relieves the electrostatic charge, so much so that the electrostatic charge can be curbed to around 0 through minus 1 KV level, which is low compared to a conventional level of 0 through 5 KV. When a medium bearing a toner-developed visible image enters the fixing nip portion, accordingly, electrostatic repulsion is relieved, the electrostatic repulsion, that is, which lies between the electrostatically adsorbed toner on the medium, namely the negatively charged toner on one hand, and the coated layer 8B3 on the pressure roller 8B on the other. This is how the toner on the medium is largely prevented from scattering in the direction of the fixing roller 8A.

The pressure roller 8B has an insulating layer 8B2 provided between the coated layer 8B3 on the surface layer and the roller core 8B1, because of the provision of which the electrostatic charge occurring in the coated layer 8B3 is precluded from abruptly discharging towards the roller core 8B1 and hence the electrostatic potential is maintained. This also retrains the likelihood of the toner being readily liberated, and scattering towards the fixing roller 8A, under the impact of turbulence of electrostatic force between toner and the coated layer of the pressure roller in the event of abrupt electric charge initiating a discharge. As a result, it is possible to create the status where both the scattering of toner towards the fixing roller 8A and an offset entailing barely occur. Also preventable in positive terms are offset-caused spoiling and other defective images.

The inventor et al used the pressure roller 8B set to the surface resistivity and experimented on the state of occurrence of offset, the result of which is shown in FIG. 3.

The toners used in the experiment come in three types, namely finer non-uniform toner of this invention (a toner having a volume mean grain size of from 5 to 10 micrometers and a grain size not larger than 5 micrometers accounting for 60 through 80 number percent), a finer uniform toner (a toner having a volume mean grain size of 5 through 10 micrometers and that contains a micro-fine toner accounting for 20 through 40 number percent because of execution of an elimination process, and a coarse toner (with a volume mean grain size of not less than 20 micrometers), with the results of experimental off-setting evaluated in four grades of excellent, good, ordinary, and bad. The surface resistivity of the pressure roll is measured in units of 10 powers up to and including $10^{5}$ through $10^{11}$ Ω/square (the experiment being made with reference to $10^{13}$ Ω/square also).

In the case of the coarse toner, unless an insulated pressure roller is used, restraining effects on offset are expected to as far an extent as electroconductivity. Given a set mean grain size of not less than 20 micrometers, the grain size of the toner powder mostly ranges between 5 and 20 micrometers or thereabouts even in the presence of toner powders not larger than 20 micrometers, which seems to mean that the micro-fine toner so small as 5 micrometers and below are practically nonexistent.

In the case of the finer uniform toner, restraining effects on offset are obtained at a surface resistivity of $10^{11}$ Ω/square. However, as the pressure roller surface approaches quite close to electroconductivity, offset becomes evident as soon as the toner-bearing medium enters the fixing apparatus.

In the case of the finer non-uniform toner, as earlier addressed as a task, it seems that as soon as the medium with toner-developed visible image on it enters the fixing apparatus, electric charge initiates an abrupt discharge between the toner-developed visible image and the pressure roller disposed on the back side of the medium, with the resultant shock transmitted to the toner on the image plane to liberate the toner towards the fixing roller in a phenomenon called offset. In the case of the finer uniform toner where micro-fine toner has been eliminated, however, the toner remains practical in service at a surface resistivity of $10^5$ through $10^6$ Ω/square.

In case of the finer non-uniform toner of this invention, the effect of preventing offset is observable only within an extremely narrow range of $10^7$ through $10^{10}$ Ω/square, and at $10^5$ through $10^6$ Ω/square particularly, a large amount of offset is confirmed no sooner has the medium entered the fixing apparatus.

According to the present invention, when the finer non-uniform toner is used, resistance property is imparted to the toner as a electrostatic propensity to an extent such that the toner is thereby prevented from scattering, a preventive measure whereby the toner is precluded from causing an offset in the direction of the fixing roller. This is how offset-induced image failure is prevented from occurring.

Moreover, since the resistance property of the pressure roller surface layer is held in a relieved status by carbon, it is possible to inhibit the toner scattering towards the fixing roller and prevent offset from entailing.

In addition, since an insulating layer is laid between the surface layer of the pressure roller and the roller core, it is possible to prevent changes in the state of toner adhesion from occurring under the impact of an abrupt discharge of electrostatic charge, without changing the electrostatic property of the surface layer.

The present document incorporates by reference the entire contents of Japanese priority documents, 2001–168335 filed in Japan on Jun. 4, 2001, 2001-191709 filed in Japan on Jun. 25, 2001, and 2002-131238 filed in Japan on May 7, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing apparatus comprising:

a transfer unit that obtains a visible image from an electrostatic latent image formed on a latent image bearing body using a developer and transfers the visible image onto a medium, wherein the developer contains a toner having a volume mean grain size of from 5 to 10 micrometers and a grain size not larger than 5 micrometers accounting for 60 through 80 number percent; and a fixing roller and a pressure roller, positioned opposite to each other with a transfer pass for the medium therebetween, that fix the visible image on the medium, wherein the surface resistivity of the pressure roller is between $1\times10^7$ through $1\times10^{10}$ Ω/square.

2. The fixing apparatus according to claim 1, wherein the pressure roller has a surface that is coated with a layer of fluroresin with a carbon content.

3. The fixing apparatus according to claim 1, wherein the pressure roller has a surface layer and a core, and an insulating layer provided between the surface layer and the core.

4. The fixing apparatus according to claim 1, wherein the toner is composed of resin constituents, colorants, wax constituents, and inorganic particulates.

5. The fixing apparatus according to claim 1, wherein the toner is manufactured by pulverization or polymerization.

6. The fixing apparatus according to claim 2, wherein the coated layer of the pressure roller contains an electroconductive agent of spherical carbon, the percentage composition of the electroconductive agent being conditional on the surface resistivity of the pressure roller standing at less than $1\times10^{10}$ Ω/square when the voltage at the time of measurement is 500V and not less than $1\times10^7$ Ω/square at 10 V.

7. The fixing apparatus according to claim 4, wherein the resin constituent is at least one selected from a group comprising styrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic acid ester copolymer, styrene-α-chloroacrylic methyl copolymer, styrene-acrylonitrile-acrylic ester copolymer and other styrene resins (polymers or copolymers containing styrene or styrene substitution product), polyester resin, epoxy resin, vinyl chloride resin, rosin modified maleic acid resin, phenol resin, polyethylene resin, polyester resin, polypropylene resin, petroleum resin, polyurethane resin, ketone resin, ethylene-ethylacrylate copolymer, xylene resin, and polyvinyl butyral.

8. The fixing apparatus according to claim 4, wherein the colorant is at least one selected from a group comprising carbon black, lampblack, iron black, ultramarine blue, nigrosine dye, aniline blue, chalco oil blue, oil black, and azo oil black.

9. The fixing apparatus according to claim 4, wherein the wax constituent is at least one selected from a group comprising a carnauba wax, rice wax, and synthetic ester wax.

10. The fixing apparatus according to claim 4, wherein the inorganic particulates is at least one selected from a group comprising silica and titanium oxide particulates.

11. An image-forming device that uses a fixing apparatus, the fixing apparatus comprising:

a transfer unit that obtains a visible image from an electrostatic latent image formed on a latent image bearing body using a developer and transfers the visible image onto a medium, wherein the developer contains a toner having a volume mean grain size of from 5 to 10 micrometers and a grain size not larger than 5 micrometers accounting for 60 through 80 number percent; and a fixing roller and a pressure roller, positioned opposite to each other with a transfer pass for the medium therebetween, that fix the visible image on the medium, wherein the surface resistivity of the pressure roller is between $1\times10^7$ through $1\times10^{10}$ Ω/square.

12. The image-forming device according to claim 11, wherein the pressure roller has a surface that is coated with a layer of fluroresin with a carbon content.

13. The image-forming device according to claim 11, wherein the pressure roller has a surface layer and a core, and an insulating layer provided between the surface layer and the core.

14. The image-forming device according to claim 11, wherein the toner is composed of resin constituents, colorants, wax constituents, and inorganic particulates.

15. The image-forming device according to claim 11, wherein the toner is manufactured by pulverization or polymerization.

16. The image-forming device according to claim 12, wherein the coated layer of the pressure roller contains an electroconductive agent of spherical carbon, the percentage composition of the electroconductive agent being conditional on the surface resistivity of the pressure roller standing at less than $1\times10^{10}$ Ω/square when the voltage at the time of measurement is 500V and not less than $1\times10^{7}$ Ω/square at 10 V.

17. The image-forming device according to claim 14, wherein the resin constituent is at least one selected from a group comprising styrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic acid ester copolymer, styrene-α-chloroacrylic methyl copolymer, styrene-acrylonitrile-acrylic ester copolymer and other styrene resins (polymers or copolymers containing styrene or styrene substitution product), polyester resin, epoxy resin, vinyl chloride resin, rosin modified maleic acid resin, phenol resin, polyethylene resin, polyester resin, polypropylene resin, petroleum resin, polyurethane resin, ketone resin, ethylene-ethylacrylate copolymer, xylene resin, and polyvinyl butyral.

18. The image-forming device according to claim 14, wherein the colorant is at least one selected from a group comprising carbon black, lampblack, iron black, ultramarine blue, nigrosine dye, aniline blue, chalco oil blue, oil black, and azo oil black.

19. The image-forming device according to claim 14, wherein the wax constituent is at least one selected from a group comprising a carnauba wax, rice wax, and synthetic ester wax.

20. The image-forming device according to claim 14, wherein the inorganic particulates is at least one selected from a group comprising silica and titanium oxide particulates.

* * * * *